US007574832B1

(12) United States Patent
Lieberman

(10) Patent No.: US 7,574,832 B1
(45) Date of Patent: Aug. 18, 2009

(54) PORTABLE TELESCOPING TOWER ASSEMBLY

(76) Inventor: Phillip L. Lieberman, 9726 E. 42nd St., Suite 233, Tulsa, OK (US) 74146

( * ) Notice: Subject to any disclaimer, the term of this patent is extended or adjusted under 35 U.S.C. 154(b) by 327 days.

(21) Appl. No.: 11/626,731

(22) Filed: Jan. 24, 2007

(51) Int. Cl.
*E04H 12/34* (2006.01)
*E04H 12/18* (2006.01)
*B66C 23/06* (2006.01)

(52) U.S. Cl. ..... 52/118; 52/121; 52/632; 212/350; 343/874

(58) Field of Classification Search ..... 52/118, 52/632, 121; 212/296, 231, 264, 348, 350; 384/29, 35, 41, 42; 173/185, 186; 343/874
See application file for complete search history.

(56) References Cited

U.S. PATENT DOCUMENTS

| | | | | | |
|---|---|---|---|---|---|
| 1,459,123 | A | | 6/1923 | Walther | |
| 2,300,763 | A | | 11/1942 | Athy | |
| 2,336,432 | A | | 12/1943 | Wilson | |
| 2,715,954 | A | | 8/1955 | Rowan | |
| 3,053,398 | A | | 9/1962 | Liebherr et al. | |
| 3,439,467 | A | | 4/1969 | Partlow | |
| 3,494,593 | A | * | 2/1970 | Blagg | 254/336 |
| 3,596,905 | A | | 8/1971 | Brown | |
| 3,958,376 | A | | 5/1976 | Campbell | |
| 3,985,234 | A | | 10/1976 | Jouffray | |
| 4,238,911 | A | * | 12/1980 | Frosch et al. | 52/111 |
| 4,337,601 | A | * | 7/1982 | Vaerk et al. | 52/118 |
| 4,357,785 | A | | 11/1982 | Eklund | |
| 4,440,262 | A | | 4/1984 | Hunt et al. | |
| 4,506,480 | A | * | 3/1985 | Murrill et al. | 52/121 |
| 4,589,520 | A | | 5/1986 | Tapfer | |
| 4,590,720 | A | * | 5/1986 | Reed | 52/121 |
| 4,748,779 | A | | 6/1988 | Ogawa | |
| 4,871,138 | A | | 10/1989 | Sauter | |
| 4,932,176 | A | * | 6/1990 | Roberts et al. | 52/118 |
| 5,101,215 | A | | 3/1992 | Creaser, Jr. | |
| 5,244,346 | A | * | 9/1993 | Fergusson | 416/142 |
| 5,423,158 | A | * | 6/1995 | Vora | 52/745.17 |
| 5,537,125 | A | * | 7/1996 | Harrell et al. | 343/878 |
| 5,557,892 | A | | 9/1996 | Lavin | |
| 6,499,612 | B1 | * | 12/2002 | Harrington et al. | 212/350 |
| 6,860,396 | B2 | * | 3/2005 | Seppala | 212/300 |
| 7,062,883 | B1 | * | 6/2006 | Langholz et al. | 52/110 |
| 7,089,705 | B1 | | 8/2006 | Lieberman | |
| 2002/0139064 | A1 | * | 10/2002 | Norwood | 52/118 |
| 2006/0028390 | A1 | | 2/2006 | Norwood | |

* cited by examiner

*Primary Examiner*—Robert J Canfield
*Assistant Examiner*—Babajide Demuren
(74) *Attorney, Agent, or Firm*—Head, Johnson & Kachigian, P.C.

(57) ABSTRACT

A portable telescoping tower assembly. The assembly includes a tower mounted on a trailer wherein the tower includes a plurality of telescoping sections that extend for use and retract and nest for storage and transportation. At least one cylindrical ram moves the tower between horizontal and vertical positions. A motor extends and retracts the plurality of sections. Each of the sections includes a plurality of external edges with each of the external edges including at least one protruding guide to mate with and receive an adjoining section.

12 Claims, 6 Drawing Sheets

PORTABLE TELESCOPING TOWER ASSEMBLY

BACKGROUND OF THE INVENTION

1. Field of the Invention

The present invention is directed to a portable, telescoping tower assembly that may be mounted on a standard trailer, vehicle, skid, or barge for rapid deployment to support equipment at desired heights. In particular, the present invention is directed to a portable, telescoping tower assembly including a series of telescoping sections that extend for use and retract and nest together for storage and transportation.

2. Prior Art

Portable tower assemblies are known and are often used to support equipment at desired heights when rapid deployment is warranted or when circumstances are of a temporary nature which do not justify permanent installation. For example, cellular telecommunications services may be desirable at a sports facility or in disaster situations. Additionally, support of lighting equipment at sporting events may be desirable. Portable towers are also used in military operations for telecommunications and detection equipment.

The portable towers are often deployed in adverse conditions, such as desert or swamp locations, which are difficult on moving components. High wind conditions can also twist components of a tower.

In one type of portable tower system, a plurality of telescoping sections are vertically movable between a retracted, nested position and an extended position. The cross-section of the sections may be triangular, square, rectangular or other shapes. Although each of the telescoping sections are similar, the sections are progressively smaller in cross-sectional area. According, the sections have progressively decreasing horizontal dimensions. Ball bearings or other bearings may be utilized to permit movement between the sections. The bearings may provide extra weight and cost. Alternatively, if the dimensions are within certain tolerances, the framework of an inner section may ride on the framework of an adjacent section.

It is important that the sections be capable of relative movement during extension and retraction of the tower. If the sections become misaligned, the sections may become jammed, and retraction or extension of the sections will be difficult or be prevented.

Prior proposals for tower assemblies include the following:

Blagg (U.S. Pat. No. 3,494,593) discloses a portable mast moved by an electric motor with triangular sections having a vertical stanchion 100 at each corner. Each stanchion 100 includes a vertical guide 102 forming a vertical channel 104 within which lugs 106 and 108 are adapted to slide.

Eklund (U.S. Pat. No. 4,357,785) discloses a telescopic mast with each section having six planar sidewalls. Internal guide grooves 5, 6 and 7 receive guide blocks 8, 9 and 10 made of plastic having a high slidability such as a high molecular polythene alloyed with a lubricant.

Walther (U.S. Pat. No. 1,459,123) discloses a telescoping tower with a series of fillers 28 secured to inner sections by rivets 30.

Rowan (U.S. Pat. No. 2,715,954) discloses a vehicle mounted tower which may be pivotally raised or lowered.

Partlow (U.S. Pat. No. 3,439,467) discloses a telescoping tower with primary guides such as vertically extending grooves 46, 47 and auxiliary guides in the form of elongated plates 51. The tower includes an electrically driven motor 43 with suitable reduction gearing means.

Campbell (U.S. Pat. No. 3,958,376) discloses a tower with tower sections, each section being smaller in size than the next adjacent section. Tower sections 130 and 120 have collars 131 and 121 which are provided with rollers 132 and 122 which contact the outer surface of the next adjacent section.

Jouffray (U.S. Pat. No. 3,985,234) discloses a boom with telescopic elements slidably engaged within one another having slide shoes 23 which bear against a lower or inner V-shaped leg 18 to self-center the elements with respect to each other.

Roberts et al. (U.S. Pat. No. 4,932,176) discloses a telescoping mast system moved between a horizontal stowed position and an upright operating position.

Harrel, Jr. et al. (U.S. Pat. No. 5,537,125) discloses a vehicle mounted broadcast antenna tower and a pair of hydraulic pistons 28 that move the tower from horizontal to vertical.

Lavin (U.S. Pat. No. 5,557,892) discloses a mast with bearings 100 mounted at the inside of each mast section, to slide up and down the outer mast section.

Norwood (U.S. Patent Application Publication No. 2006/0028390) discloses a cell phone telescoping tower raised or lowered from storage to operating position by hydraulic cylinder.

Notwithstanding the foregoing, there remains a need to provide a portable, telescoping tower assembly which is simple and cost effective to construct and operate.

Accordingly, it would be desirable to provide a portable, telescoping tower assembly with a guide mechanism that will permit efficient and rapid deployment and retraction of the sections of the telescoping tower.

It would also be desirable to provide a guide mechanism for adjoining sections of a tower assembly which are simple to construct, efficient to operate, and which does not require any lubrication.

It would also be desirable to provide a portable tower assembly with telescoping sections having guides that are easily replaceable.

SUMMARY OF THE INVENTION

The present invention is directed to a portable telescoping tower assembly which includes a tower mounted on a vehicle or a trailer. The trailer includes framework mounted on a trailer bed having a pair of pivotal connections or pivots, which provide an axis for rotation of a tower frame of the tower. The tower may be moved between a horizontal position for storage and transportation and a vertical position for use by a pair of cylindrical rams which are pivotally attached to the tower frame of the tower offset from the pivots.

The tower includes a plurality of telescoping sections with the uppermost sections supporting a bracket for mounting desired equipment.

Each of the successive sections are progressively smaller in cross sectional area to permit nesting of the sections.

The telescoping sections are moved from the retracted position to an extended position by a direct drive electric motor in communication with a gear reducer and winch mechanism.

Each section includes three parallel tubes equally spaced from each other. The outer edge of each tube forms a rail with an external edge to act as a guiding rail for interaction with an adjacent larger section. Additionally, the inner edge of each tube forms a rail with an internal edge to act as a guiding rail. Protruding guides extending from the tubes act as bearing surfaces and guide mechanisms for movement between the sections. A mounting plate is welded or otherwise affixed to a tubular rail. A pair of plastic panes each include a reduced thickness portion. The panels are brought together with the reduced thickness portion sandwiched around the mounting plate and are fastened thereto. An end of each plastic panel is beveled, chamfered, or provided with a radius. When the panels are brought together and joined, the ends form a cupped or radiused surface which will receive the rail of the adjacent section.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
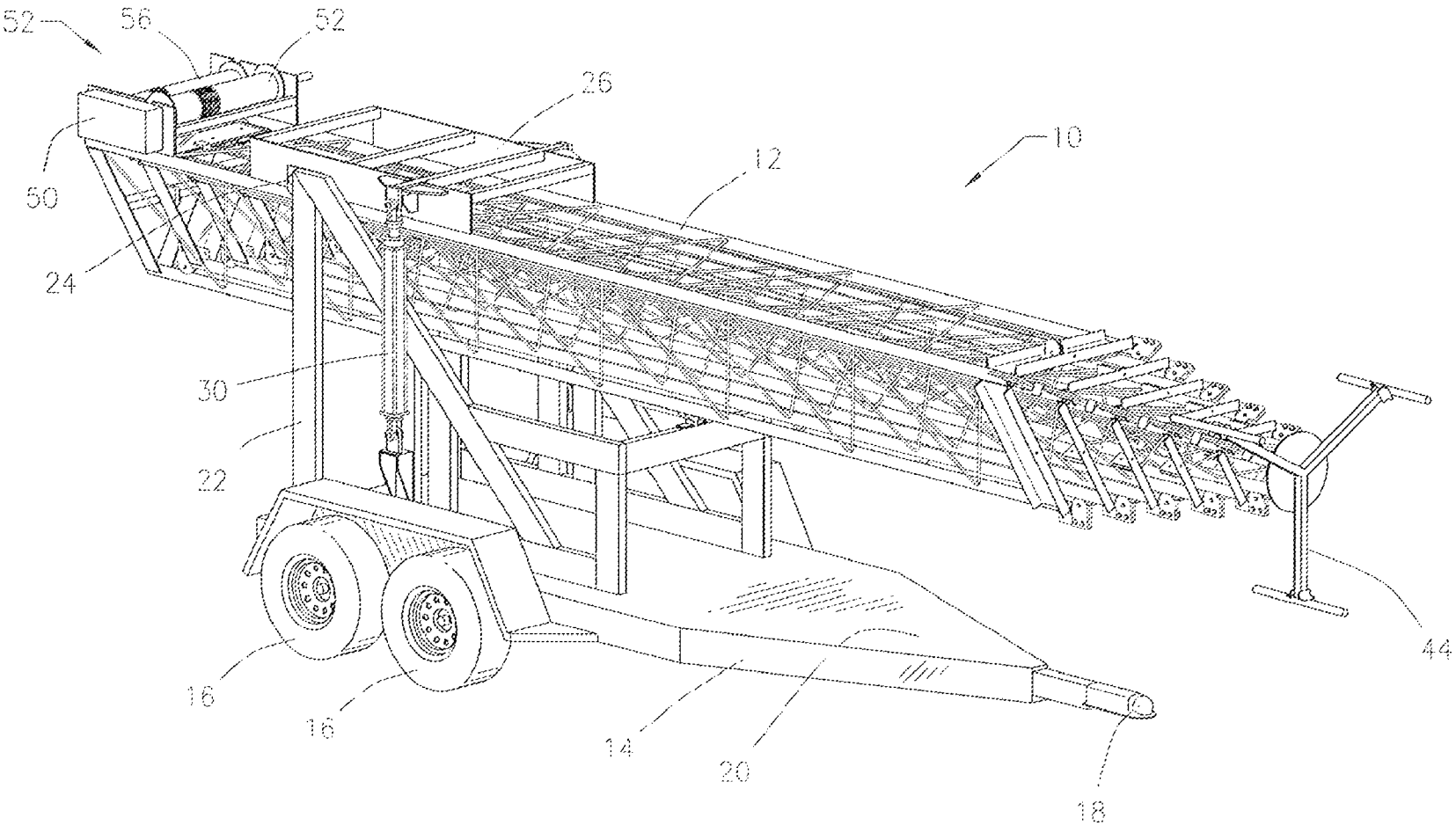
FIG. 1 is a perspective view of a portable telescoping tower assembly constructed in accordance with the present invention in a horizontal, storage and transportation position.

Referring to the drawings in detail, FIG. 1 illustrates a perspective view of a portable telescoping tower assembly 10 constructed in accordance with the present invention which is in the horizontal, storage and transportation position.

The assembly 10 includes a tower 12 which will be described in detail below. The tower 12 is mounted on a vehicle, such as a truck, or on a trailer 14. The tower 12 might alternatively be mounted on or in a skid or barge. The trailer 14 includes a plurality of wheels 16, a hitch 18 for connection with a vehicle (not shown), and a bed 20. The trailer 14 is no wider than the maximum width permitted on highways and is, accordingly, highly mobile.

The trailer 14 also includes a framework 22 mounted on the trailer bed having a pair of pivotal connections or pivots 24. The pivots 24 provide an axis for rotation of a tower frame 26 of the tower 12.

Figure 2:
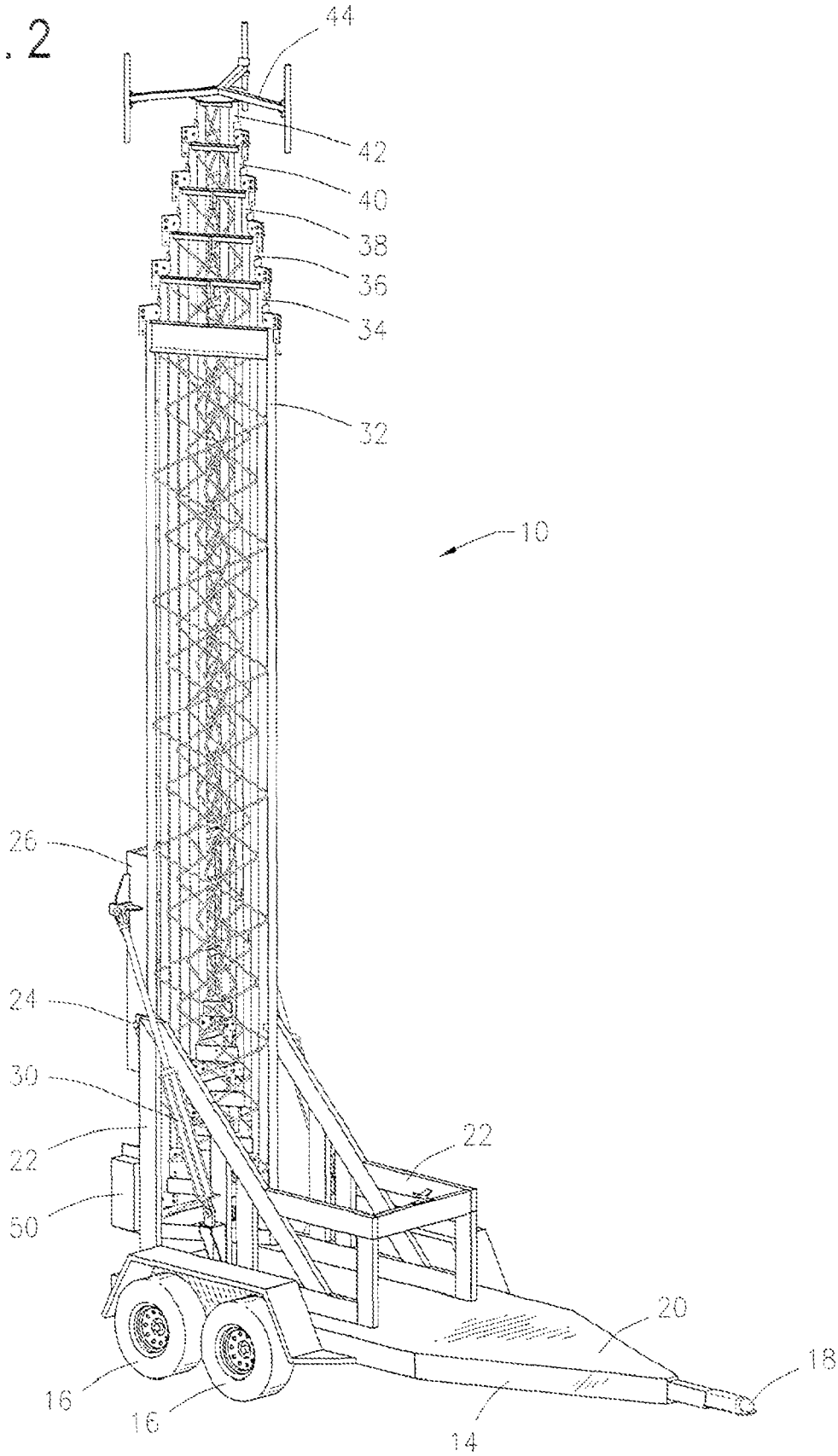
FIG. 2 is a perspective view of the portable telescoping tower assembly shown in FIG. 1 in an upright or vertical position.

FIG. 2 illustrates a perspective view of the tower assembly 10 with the tower 12 in an upright position so that the sections may be extended for deployment.

The tower 12 is moved between the horizontal position in FIG. 1 and the vertical position in FIG. 2 by a pair of cylindrical rams 30 (only one visible in FIG. 1). The cylindrical rams 30 are powered by a hydraulic or pneumatic power supply such as a pump (not shown) and will include controllable valves, all of which are well-known in the art. The cylindrical rams 30 are pivotally attached to the tower frame 26 of the tower 12 offset from the pivots 24 so that when the rams are extended, the tower 12 will rotate about the axis of the pivots 24 to vary the angular position of the tower.

The tower 12 includes a plurality of telescoping sections 32, 34, 36, 38, 40 and 42 fabricated primarily from metal. The uppermost section 42 supports a bracket 44 for mounting desired equipment, such as cellular telecommunications transceivers (not shown).

Each of the successive sections 32, 34, 36, 38, 40 and 42 are progressively smaller in cross-sectional area to permit nesting of the sections as seen in FIGS. 1 and 2.

Figure 3:
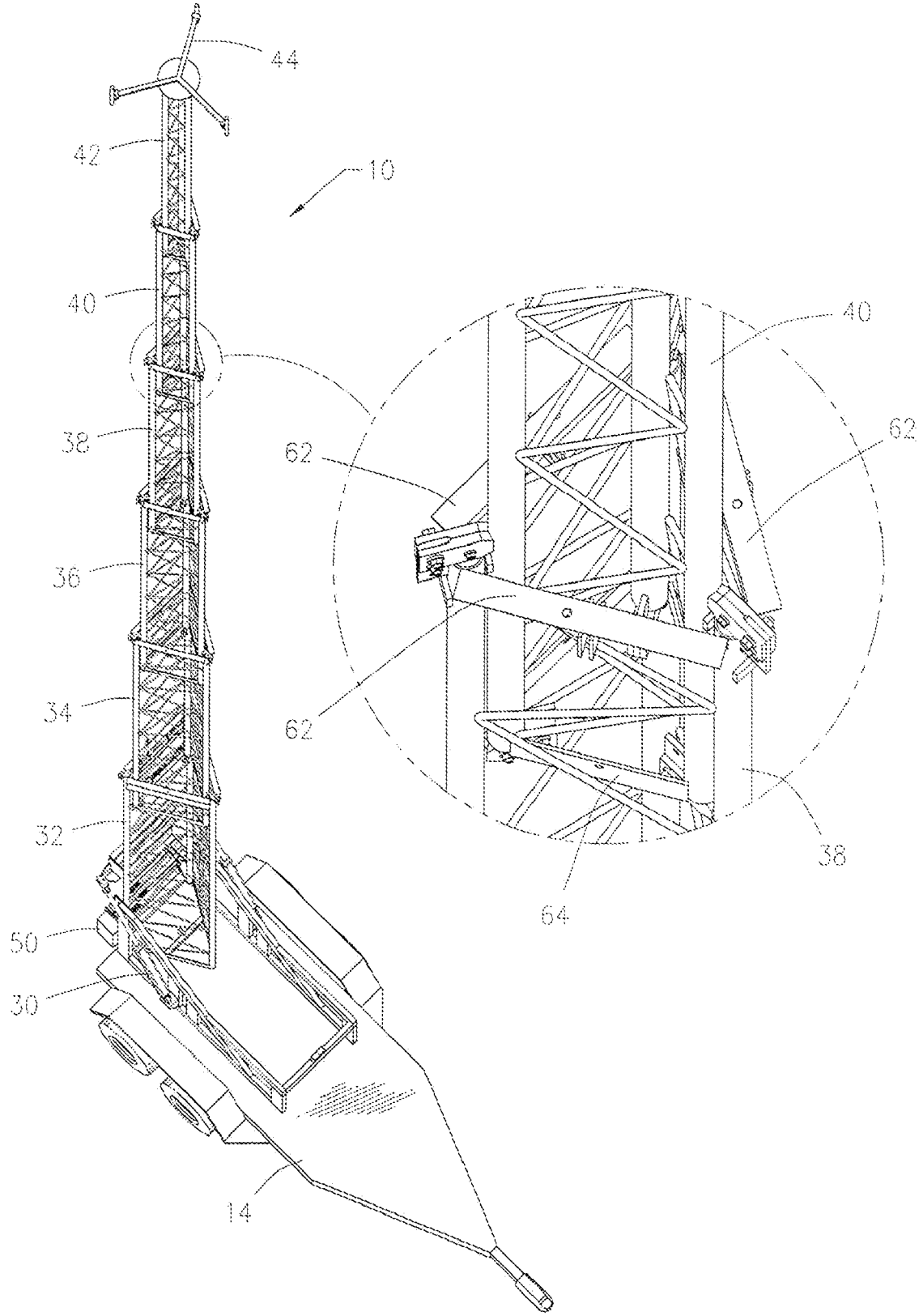
FIG. 3 is a perspective view of the portable telescoping tower assembly shown in FIG. 2 with sections extended or deployed for use.

The telescoping sections are moved from a retracted position shown in FIG. 2 to an extended position shown in FIG. 3 by a direct drive electric motor 46 in communication with a gear reducer 50 connected to a chain drive and winch mechanism 52. A cable 54 is wound around a drum 56 and then to a pulley system on the telescoping sections 32, 34, 36, 38, 40 and 42 in order to raise the sections, all as is well known in the art. In one non-limiting example, a 1.5 horsepower direct drive electric motor is used with a 300 to 1 gear reducer. An optional electric generator (not shown) may be mounted on the bed 20 of the trailer.

Figure 4:
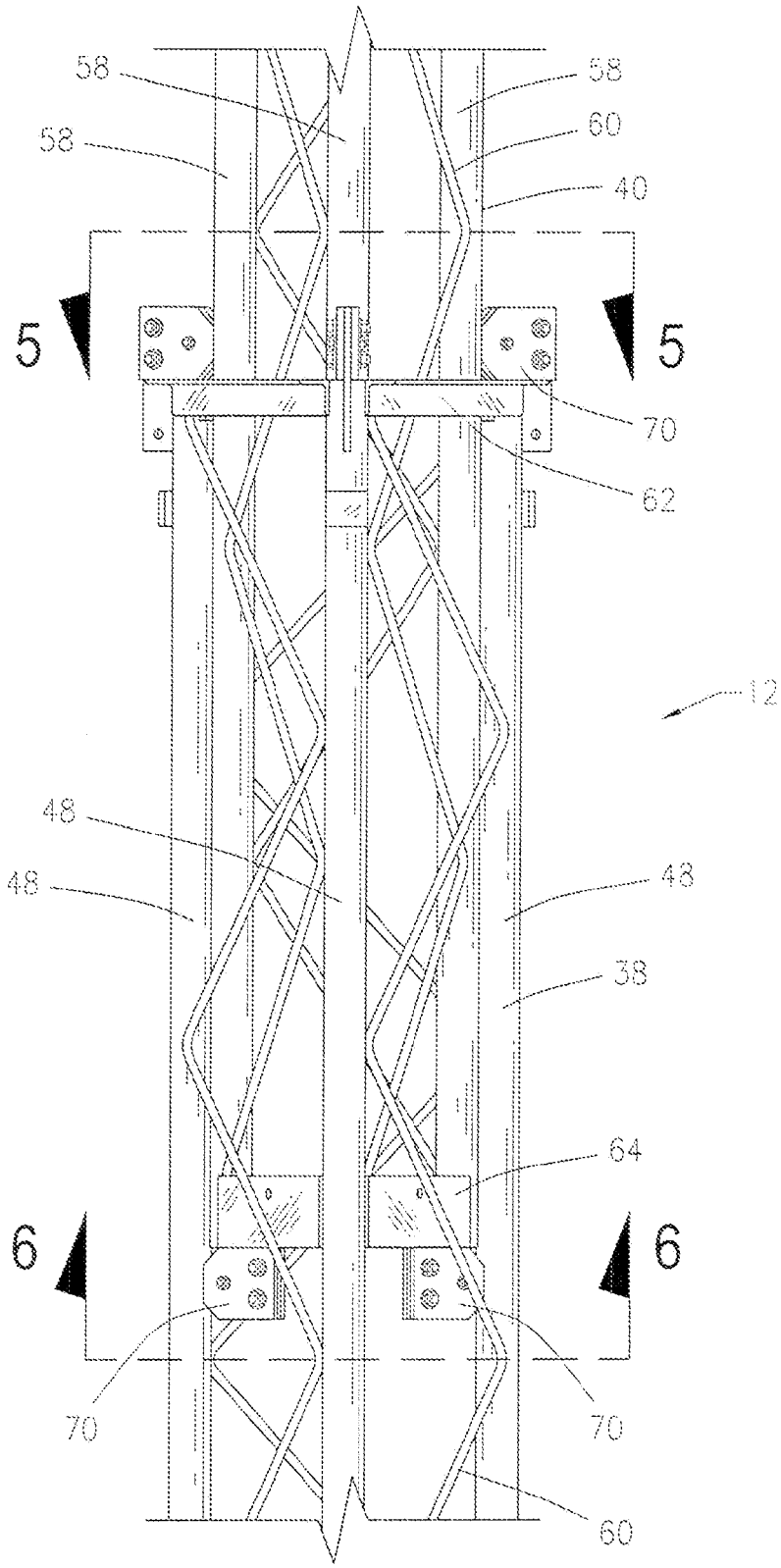
FIG. 4 is an enlarged view of portions of the sections of the tower assembly shown in FIG. 3.

FIG. 3 illustrates a perspective view of the tower assembly 10 with the tower 12 in the extended position with a portion in dashed lines enlarged for clarity. FIG. 4 illustrates a plan view of the portion of the tower 12 shown in FIG. 3 and the connection between section 38 and section 40.

Figure 5:
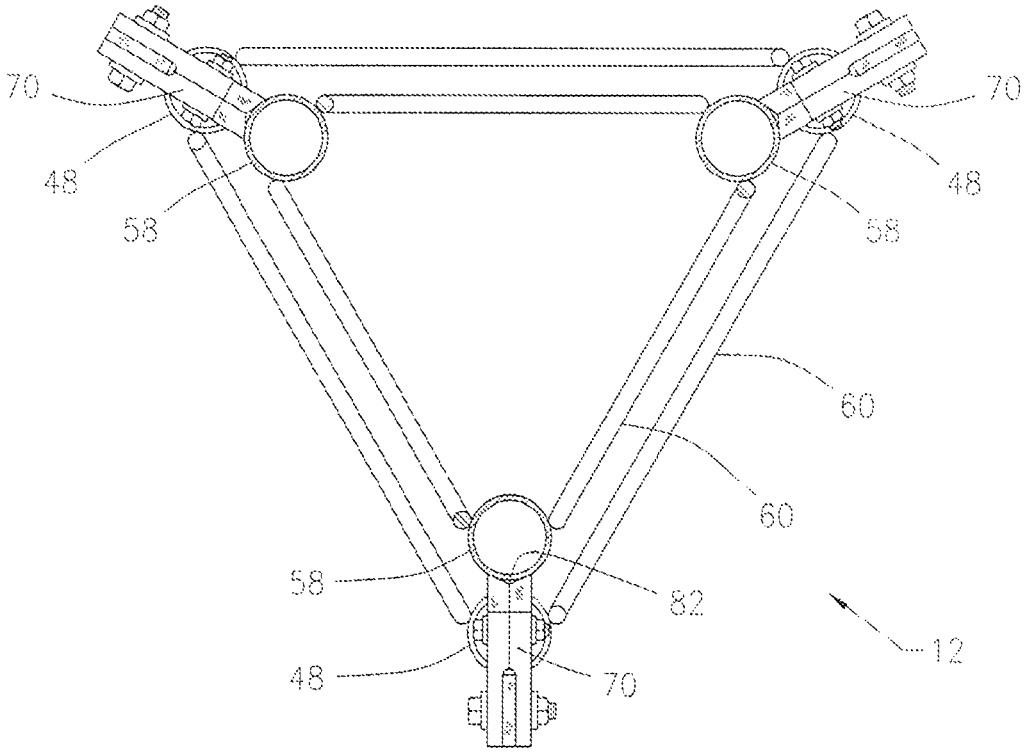
FIG. 5 is a sectional view taken along section line 5-5 of FIG. 4
Figure 6:
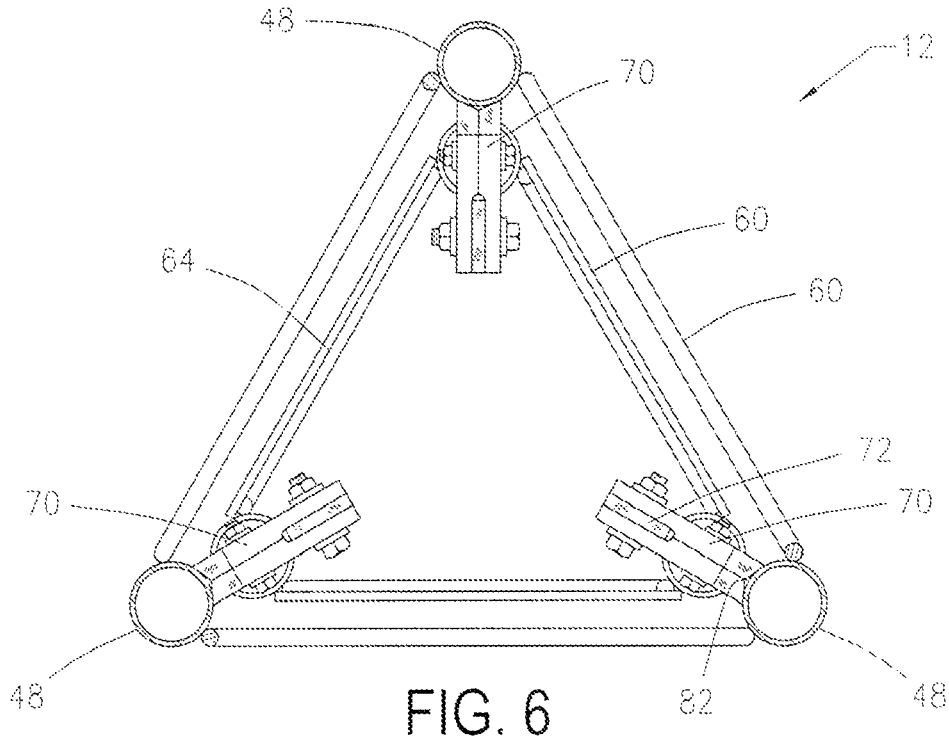
FIG. 6 is a sectional view taken along section line 6-6 of FIG. 4.

FIG. 5 illustrates a sectional view taken along section line 5-5 of FIG. 4 and FIG. 6 is a sectional view taken along section line 6-6 of FIG. 4.

Each section 32, 34, 36, 38, 40 and 42 is constructed in substantially the same way. As seen in FIGS. 4, 5 and 6, each section includes three parallel tubes equally spaced from each other approximately one hundred twenty degrees (120°) apart to form a triangle in cross-section. For example, section 38 includes tubes 48 while section 40 includes tubes 58. The outer edge of each tube 58 forms a rail with an external edge to act as a guiding rail for interaction with an adjacent, larger section 38. For example, the three tubes 58 in section 40 each have external edges which form three rails for interaction with section 38 as best seen in FIG. 5.

It will be appreciated that the present embodiment includes three equally spaced rails to form a triangle. Four rails in the configuration of a square or rectangle or even other configurations are possible within the spirit and scope of the present invention.

Extending between the three equally spaced tubular rails is a connecting structure or webbing 60. It will be appreciated that other types of connecting structure might be employed. Also extending between the three tubular rails are angle irons 62 and plates 64.

The inner edge of each tube 48 forms a rail with an internal edge to act as a guiding rail. A protruding guide 70 extends in a direction outward from the external edge of each tubular rail 58 of section 40 and mates with the inner edge of each tubular rail 48 of section 38.

Figure 7:
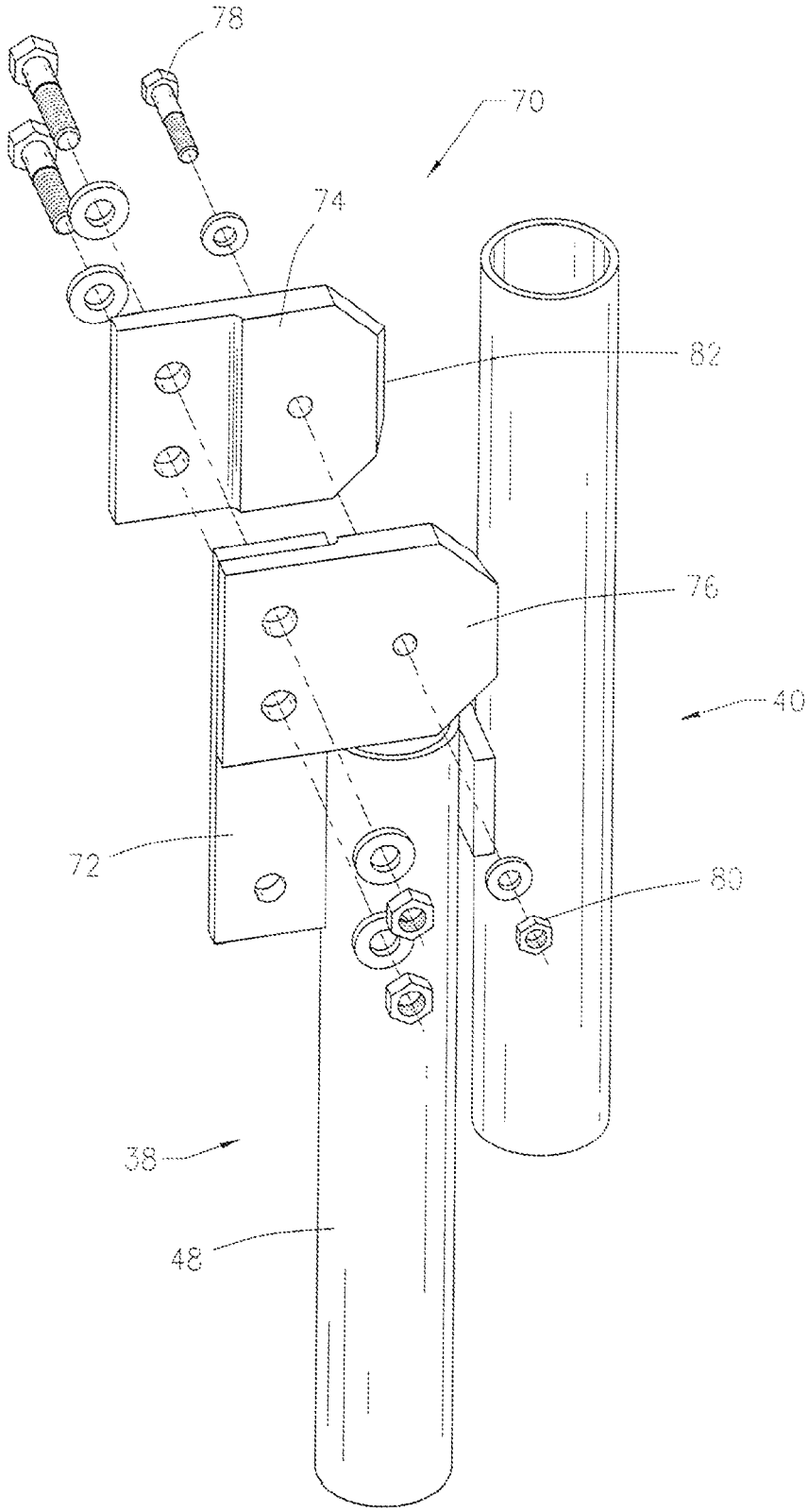
FIG. 7 is an exploded view of the protruding guide which is a part of the portable telescoping tower assembly of the present invention.

FIG. 7 illustrates an exploded view of a portion of the section 38 and the adjoining section 40 of the tower. The protruding guide 70 is exploded for clarity. A mounting plate 72 is welded or otherwise affixed to the tubular rail 48 of section 38 and extends outward therefrom. A pair of plastic panels 74 and 76 each include a reduced thickness portion. The panels may be composed of a thermoplastic polyoxymethylene, such as Delrin™, which has a low coefficient of friction. The panels 74 and 76 are brought together, with the reduced thickness portions sandwiched around the mounting plate 72, and are fastened with bolts 78, washers, and nuts 80. An end 82 of each plastic panel 74 and 76 is beveled, chamfered or provided with a radius. When the panels are brought together, the ends 82 form a cupped or radiused surface which will receive the rail 58 of section 40. The guides thus provide bearing surfaces for movement of the sections with respect to each other, without lubrication.

The present invention provides a relatively narrow and low profile design that permits transportation in a standard 40 foot ocean container.

Whereas, the present invention has been described in relation to the drawings attached hereto, it should be understood that other and further modifications, apart from those shown or suggested herein, may be made within the spirit and scope of this invention.

What is claimed is:

1. A portable telescoping tower assembly, which comprises:

a trailer;

a tower having a plurality of telescoping sections that extend for use and retract and nest for storage and transportation;

at least one cylindrical ram to move said tower between horizontal and vertical positions;

a motor to extend and retract said plurality of sections; and each of said sections including a plurality of external edges, each of said external edges including at least one protruding guide to mate with and receive an adjoining section, wherein each said guide is fabricated from a pair of plastic panels, each said panel having a beveled edge so that said pair of plastic panels together form a groove to mate with said adjoining section.

2. A portable telescoping tower assembly as set forth in claim 1 wherein said external edges of each said section comprise three tubular rails forming a triangular cross-section and wherein said at least one protruding guide mates with tubular rails of said adjoining section.

3. A portable telescoping tower assembly as set forth in claim 1 wherein said at least one cylindrical ram is a pair of hydraulic rams.

4. A portable telescoping tower assembly as set forth in claim 1 wherein said trailer includes wheels and a hitch.

5. A portable telescoping tower assembly as set forth in claim 1 wherein said plastic panels are composed of a thermoplastic polyoxymethylene.

6. A portable telescoping tower assembly as set forth in claim 1 wherein said pair of plastic panels is bolted to a mounting plate extending from said external edge.

7. A portable telescoping tower assembly as set forth in claim 1 wherein said motor includes a direct drive electric motor in communication with a gear reducer connected to a chain drive.

8. A portable telescoping tower assembly which comprises:

a tower, said tower having a plurality of telescoping sections that extend for use and retract and nest together for storage and transportation;

a pair of hydraulic cylindrical rams to move said tower between horizontal and vertical positions;

an electric motor and a winch to extend and retract said plurality of sections; and each of said sections including three tubular rails having external edges, with each of said rail external edges including at least one protruding guide to mate with and receive one of said tubular rails from an adjoining section, wherein each said guide is fabricated from a pair of plastic panels, each said panel having a beveled edge so that said pair of plastic panels together form a groove to mate with said adjoining section.

9. A portable telescoping tower assembly as set forth in claim 8 wherein said vehicle includes a trailer having wheels.

10. A portable telescoping tower assembly as set forth in claim 8 wherein each said protruding guide is fabricated from a pair of plastic panels which are bolted to a mounting plate.

11. A portable telescoping tower assembly which comprises:

a trailer;

a tower having a plurality of telescoping sections that extend for use and retract and nest for storage and transportation;

at least one cylinder to move said tower between horizontal and vertical positions;

a motor to extend and retract said plurality of sections;

each section having tubular rails having external edges; and a guide mechanism including at least one protruding guide from each said external edge which mates with and receives one of said tubular rails from an adjoining section, wherein each said guide is fabricated from a pair of plastic panels, each said panel having a beveled edge so that said pair of plastic panels together form a groove to mate with said adjoining section.

12. A portable telescoping tower assembly as set forth in claim 11 wherein said plastic panels are composed of a thermoplastic polyoxymethylene.

* * * * *